US008608164B2

(12) United States Patent
Takai et al.

(10) Patent No.: US 8,608,164 B2
(45) Date of Patent: Dec. 17, 2013

(54) SHEET CONVEYING APPARATUS AND IMAGE FORMING APPARATUS

(75) Inventors: Shingo Takai, Ibaraki (JP); Makoto Nakura, Ibaraki (JP); Naoto Ueda, Ibaraki (JP); Satoshi Ueda, Ibaraki (JP); Akira Kobashi, Ibaraki (JP); Koichi Kudo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/590,480

(22) Filed: Aug. 21, 2012

(65) Prior Publication Data

US 2013/0049296 A1 Feb. 28, 2013

(30) Foreign Application Priority Data

Aug. 22, 2011 (JP) ..... 2011-180295
May 30, 2012 (JP) ..... 2012-123114

(51) Int. Cl.
*B65H 7/02* (2006.01)

(52) U.S. Cl.
USPC ..... 271/265.02

(58) Field of Classification Search
USPC ..... 271/259, 265.02, 272
See application file for complete search history.

(56) References Cited

U.S. PATENT DOCUMENTS 5,222,728 A * 6/1993 Takahashi ..... 271/242
5,543,909 A * 8/1996 Quesnel ..... 399/394
5,738,349 A * 4/1998 Shirasaki ..... 271/242
7,883,083 B2 * 2/2011 Fukasawa ..... 271/10.03
8,131,171 B2 3/2012 Ohshima et al.
2010/0239282 A1 9/2010 Ashikawa et al.
2010/0329759 A1 12/2010 Furuya et al.
2011/0058828 A1 * 3/2011 Tsukamoto et al. ..... 399/45
2011/0064425 A1 3/2011 Kazama et al.
2011/0076077 A1 3/2011 Morofuji et al.

FOREIGN PATENT DOCUMENTS

JP 2007-331850 12/2007
JP 2010-089900 4/2010
JP 2010-241600 10/2010
JP 2010-271407 12/2010
JP 2011-006202 1/2011
JP 2011-020842 2/2011
JP 2011-063332 3/2011
JP 2011-068460 4/2011
JP 2011-079662 4/2011
JP 2011-126698 6/2011

* cited by examiner

*Primary Examiner* — Jeremy R Severson
(74) *Attorney, Agent, or Firm* — IPUSA, PLLC

(57) ABSTRACT

A sheet conveying apparatus including: a sheet conveying unit; an upstream side guiding member that forms an upstream side conveying route of a sheet; a downstream side guiding member that forms a downstream side conveying route of the sheet; an upstream side detection unit; and a downstream side detection unit, wherein a detection position of the sheet for the upstream side detection unit is set between the sheet conveying unit and a position where the sheet is in contact with the upstream side guiding member, and a detection position of the sheet for the downstream side detection unit is set between the sheet conveying unit and a position where the sheet is in contact with the downstream side guiding member.

12 Claims, 8 Drawing Sheets

SHEET CONVEYING APPARATUS AND IMAGE FORMING APPARATUS

CROSS-REFERENCE TO RELATED APPLICATIONS

The present application is based upon and claims the benefit of priorities of Japanese patent application No. 2011-180295, filed on Aug. 22, 2011 and Japanese patent application No. 2012-123114, filed on May 30, 2012, the entire contents of which are incorporated by reference in their entirety.

BACKGROUND OF THE INVENTION

1. Field of the Invention

The present invention relates to a sheet conveying apparatus and an image forming apparatus.

2. Description of the Related Art

In the commercial printing industry, in order to print various kinds of variable data of small lots, the conventional offset printing is shifting to POD (Print on Demand) using an image forming apparatus of an electrophotographic scheme. In the image forming apparatus using the electrophotographic scheme, accuracy of front-to-back registration equivalent to the offset printer is being required in order to meet the needs of POD.

Factors of front-to-back misregistration can be largely classified to a registration error in vertical and lateral directions, and a skew error of sheet/image. For an image forming apparatus having a heat fixing device, an image scaling error due to expansion and contraction of the sheet is added as a factor.

In order to automatically correct the image scaling error between the front and the back of the sheet, it is necessary to accurately measure a sheet size and a distance by which the sheet is conveyed. Various techniques have been proposed to achieve this objective. But, there is a problem in that measurement accuracy deteriorates due to inadequate detection accuracy of a sheet.

SUMMARY OF THE INVENTION

Accordingly, it is an object of an embodiment of the present invention to provide a sheet conveying apparatus that can improve detection accuracy of a sheet to be conveyed with a simple structure.

According to an embodiment, there is provided a sheet conveying apparatus including:

a sheet conveying unit configured to convey a sheet;

an upstream side guiding member that is provided in an upstream side of a conveying direction of the sheet conveying unit, and that forms an upstream side conveying route of the sheet;

a downstream side guiding member that is provided in a downstream side of the conveying direction of the sheet conveying unit, and that forms a downstream side conveying route of the sheet;

an upstream side detection unit configured to detect the sheet conveyed in the upstream side conveying route;

a downstream side detection unit configured to detect the sheet conveyed in the downstream side conveying route;

wherein a detection position of the sheet for the upstream side detection unit is set between the sheet conveying unit and a position where the sheet is in contact with the upstream side guiding member, in a conveying state where the sheet is conveyed by the sheet conveying unit and the sheet is in contact with the upstream side guiding member and the downstream side guiding member, and a detection position of the sheet for the downstream side detection unit is set between the sheet conveying unit and a position where the sheet is in contact with the downstream side guiding member in the conveying state.

According to the sheet conveying apparatus, detection accuracy of a sheet to be conveyed can be improved.

Other objects and further features of the present invention will be apparent from the following detailed description when read in conjunction with the accompanying drawings.

DESCRIPTION OF THE PREFERRED EMBODIMENTS

Figure 1:
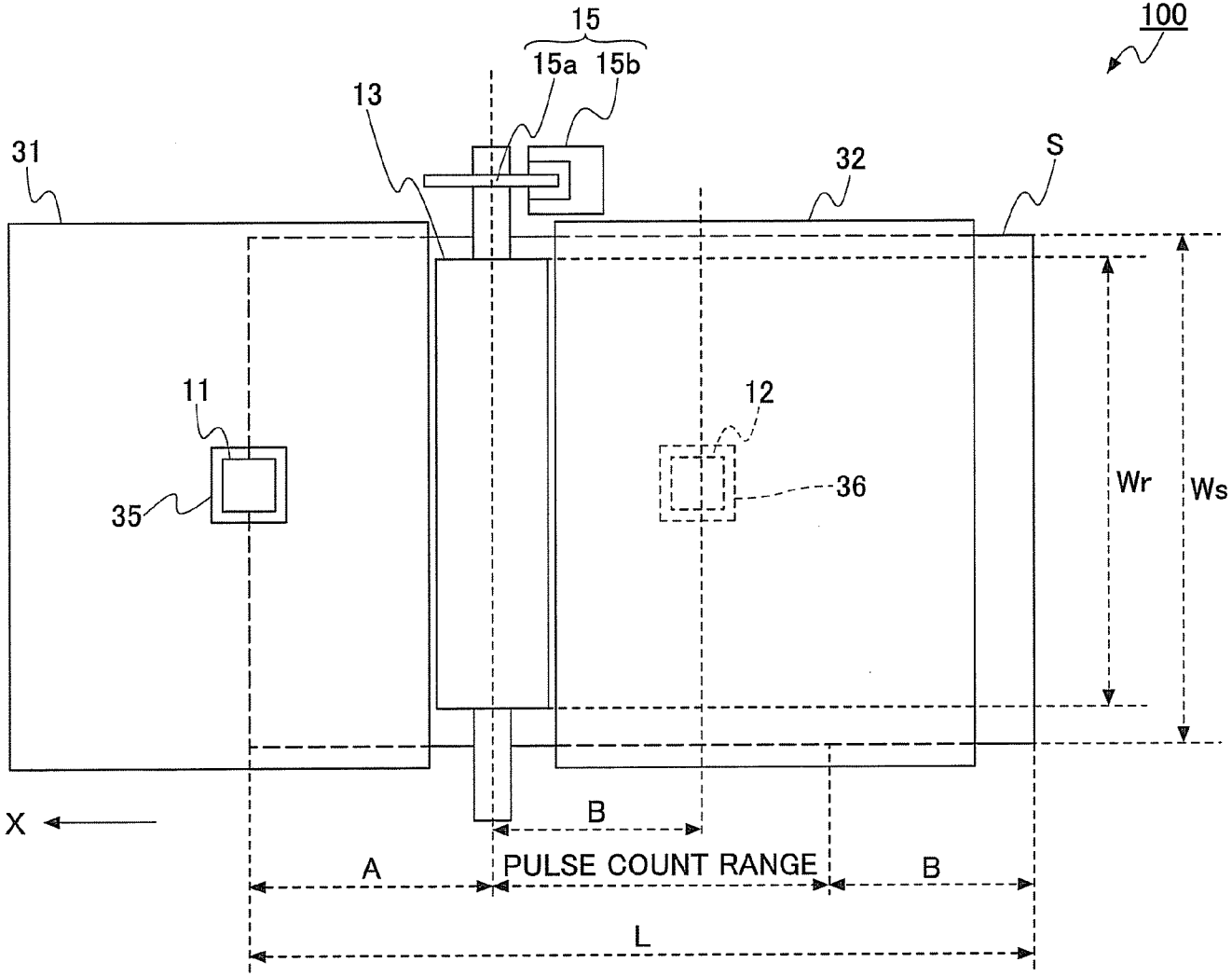
FIG. 1 is a schematic top view of a sheet conveying apparatus of an embodiment.

Prior to describing an embodiment of the present invention, the problem will be described in more detail for convenience of understanding.

In order to automatically correct the image scaling error between the front and the back of the sheet, a technique is necessary for automatically and accurately measuring a sheet size and a distance by which the sheet is conveyed. For that purpose, there is a technique for detecting passage of a top end and a rear end of the sheet to be conveyed with a sensor and measuring the sheet length based on the passing time, and also, there is a technique for measuring the sheet length based on a pulse counting result of a rotary encoder provided on an axis of a sheet conveying roller. In addition, a technique is known for improving measurement accuracy of the sheet length by using both of the encoder pulse counting and the speed measurement of the sheet.

For example, there is an apparatus including a rotation amount measurement unit and edge sensors (disclosed in Japanese Laid-Open Patent Applications No. 2010-241600, No. 2011-006202, and No. 2011-020842, for example). The rotation amount measurement unit measures a rotation amount of a length measurement roll that rotates while being driven by a sheet to be conveyed, and the edge sensors detect passage of an end part of the sheet. The apparatus measures the length of the sheet and the like accurately based on the rotation amount of the length measurement roll and outputs of the edge sensors.

However, in the above-mentioned technique, the sheet flutters when it is conveyed at the position where the edge sensor detects passage of the end part of the sheet. Thus, the distance between the edge sensor and the sheet varies so that there is a case where measurement accuracy of the sheet length deteriorates.

In Japanese Laid-Open Patent Application No. 2010-089900, a method is proposed for decreasing variations of the conveying position of the sheet by providing an auxiliary guiding member in an upstream side of a pair of sheet conveying rollers. The auxiliary guiding member guides the sheet upward, and after that, brings the sheet in contact with a lower guiding plate by folding back the sheet.

In addition, for example, in Japanese Laid-Open Patent Application No. 2007-331850, a sheet conveying apparatus is proposed for reducing sheet fluttering by conveying the sheet along a conveying route such that the sheet is in contact with the conveying route.

However, in the technique of Japanese Laid-Open Patent Application No. 2010-089900, since the auxiliary guiding member is necessary, the configuration of the apparatus becomes complicated and the conveying route of the sheet is narrowed, which may hinder sheet conveyance.

Also, in the technique of Japanese Laid-Open Patent Application No. 2007-331850, the sheet is ejected such that the sheet is in contact with the conveying route. However, the sheet does not necessarily keep in contact with the conveying route when it is conveyed. Thus, variations of the position of the sheet occur at the detection position, so that detection accuracy deteriorates.

In the following embodiment, a sheet conveying apparatus is provided that can improve detection accuracy of a sheet with a simple structure.

In the following, an embodiment of the present invention is described with reference to figures.

<Configuration of the Sheet Conveying Apparatus>

Figure 2:
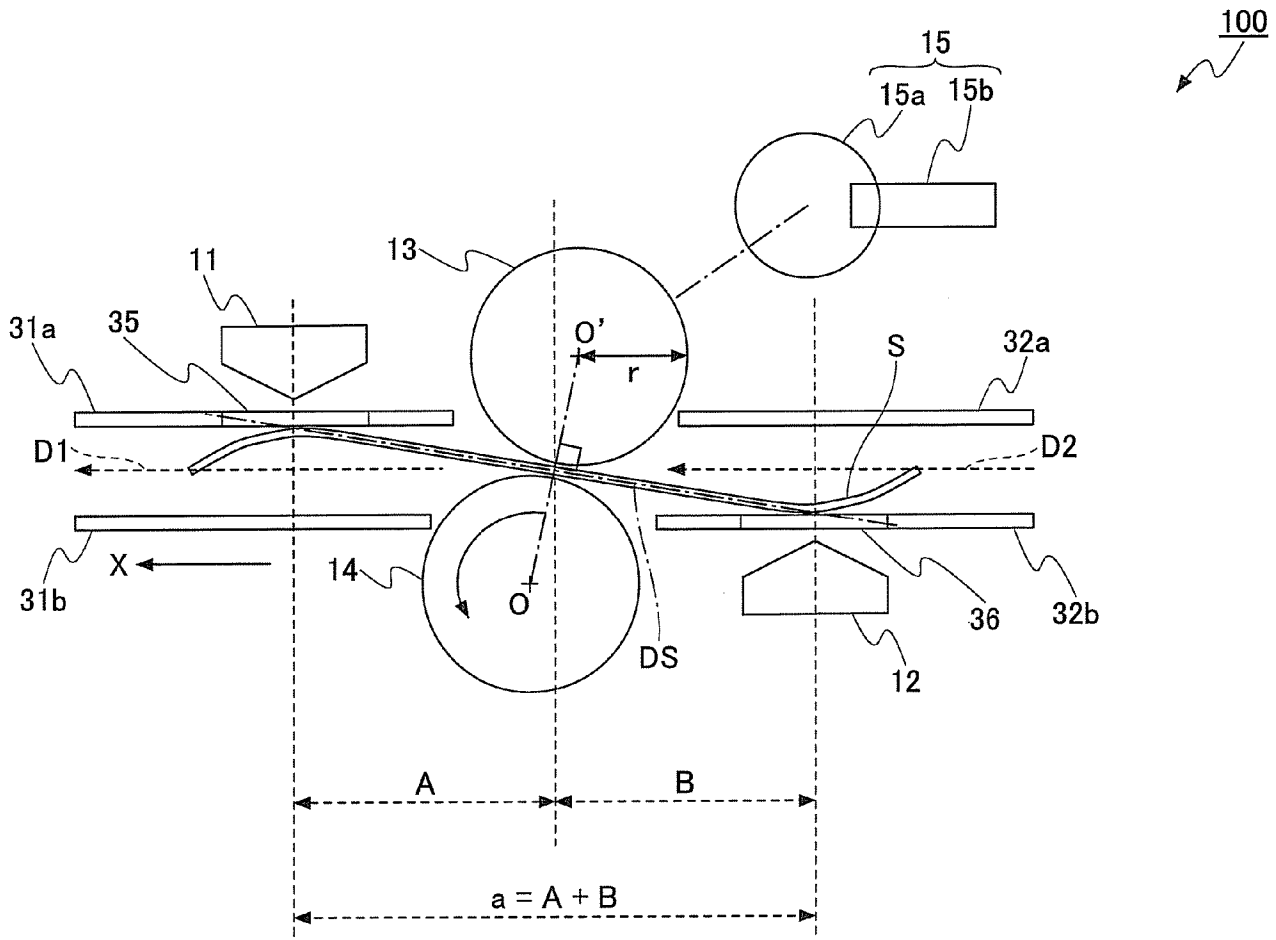
FIG. 2 is a schematic sectional view of the sheet conveying apparatus of an embodiment.

FIGS. 1 and 2 show schematic views of a sheet conveying apparatus 100 of the present embodiment. FIG. 1 is a schematic top view of the sheet conveying apparatus 100, and FIG. 2 is a schematic sectional view of the sheet conveying apparatus 100.

Two rollers are provided on a conveying route of a sheet S such as a sheet or an OHP or the like, wherein the two rollers forms a conveying unit for transferring the sheet S by sandwiching it between the rollers. In the present embodiment, a driving roller 14 and a driven roller 13 are provided. The driving roller 14 rotates by a driving unit (such as a motor, for example, not shown in the figure) and a driving force transfer unit (such as a gear and a belt, for example, not shown in the figure). The driven roller 13 rotates by following the rotation of the driving roller 14 while sandwiching the sheet S between the driving roller 14 and the driven roller 13. The unit of the driven roller 13 and the driving roller 14 is an example of a conveying unit for conveying the sheet S.

The driving roller 14 includes a rubber layer on its surface in order to produce sufficient friction between the driving roller 14 and the sheet S. The driving roller 14 conveys the sheet S while the sheet S is sandwiched between the driving roller 14 and the driven roller 13.

The driven roller 13 is placed such that it is in contact with the driving roller 13 and applies pressure on the driving roller 13 by a pushing unit (spring and the like, for example, not shown in the figure). When the driving roller 14 rotates and conveys the sheet S, the driven roller 13 rotates by the friction between the sheet S and the driven roller 13.

The length Wr of the driven roller 13 in the width direction that is perpendicular to the conveying direction of the sheet S is less than the minimum width of the sheet S that the sheet conveying apparatus 100 supports. Therefore, when the sheet S is conveyed, the driven roller 13 does not contact the driving roller 14. Thus, the driven roller 13 is driven only by the friction between the driven roller 13 and the sheet S. Therefore, the conveying distance of the sheet S can be measured accurately without influence from the driving roller 14. The apparatus can be also configured such that the position relation relationship between the driven roller 13 and the driving roller 14 is reversed.

A rotary encoder 15 is provided on a rotation axis of the driven roller 13 of the sheet conveying apparatus 100 of the present embodiment. A pulse counting unit counts a pulse signal generated by a rotating encoder disc 15*a* and an encoder sensor 15*b* to measure a rotation amount of the driven roller 13 as a conveying amount of the sheet. The pulse counting unit is an example of a conveying amount measurement unit for measuring a conveying amount of the sheet.

Although the rotary encoder 15 is provided on the rotation axis of the driven roller 13 in the present embodiment, the driven roller 13 may be provided on a rotation axis of the driving roller 14. Also, the less the diameter of the roller attaching the rotary encoder 15 is, the greater the number of pulses to be counted is, since the number of times of rotation due to sheet conveying increases. Thus, it is preferable that the roller diameter is small since the conveying distance of the sheet S can be measured accurately.

Also, it is preferable that the driven roller 13 or the driving roller 14 to which the rotary encoder 15 is attached is metal in order to maintain axis swing accuracy. By suppressing swing of the rotation axis, the conveying distance of the sheet S can be measured accurately.

As shown in FIG. 2, downstream side guiding members 31*a* and 31*b* are provided in the downstream side of the conveying direction of the driven roller 13 and the driving roller 14, in which the downstream side guiding members 31*a* and 31*b* (which may be also referred to as a downstream side guiding member (31)) form a downstream side conveying route D1 of the sheet. Upstream side guiding members 32*a* and 32*b* are provided in the upstream side of the conveying direction, in which the upstream side guiding members 32*a* and 32*b* (which may be also referred to as an upstream side guiding member (32)) form an upstream side conveying route D2 of the sheet.

The pair of the downstream side guiding members 31*a* and 31*b* is a member like a pair of plates for guiding the sheet S from both sides of the sheet S. Also, the pair of the upstream side guiding members 32*a* and 32*b* form a member like a pair of plates for guiding the sheet S from both sides of the sheet S. The downstream side guiding members 31*a* and 31*b* are evenly spaced, and the interval is about 3 mm, for example. The upstream side guiding members 32*a* and 32*b* are evenly spaced, and the interval is about 3 mm, for example.

The downstream side conveying route D1 of the sheet S is formed by the downstream side guiding members 31*a* and 31*b* that are provided in the downstream side of the conveying direction of the sheet S. The upstream side conveying route D2 of the sheet S is formed by the upstream side guiding members 32*a* and 32*b* that are provided in the upstream side of the conveying direction of the sheet S. The downstream side conveying route D1 and the upstream side conveying route D2 are parallel to each other, and the sheet S is conveyed from the upstream side conveying route D2 to the downstream side conveying route D1.

The driving roller 14 and the driven roller 13 are placed such that a line connecting the centers O-O' on the section of the driving roller 14 and the driven roller 13 is not perpendicular to the conveying routes D1 and D2 of the sheet S formed by the guiding members 31 and 32. That is, the line connecting the centers O-O' is tilted at an angle with respect to a virtual line perpendicular to the line of the conveying routes D1 and D2.

By configuring the apparatus like this, as shown in FIG. 2, the conveying direction DS of the sheet S conveyed by the driven roller 13 and the driving roller 14 is inclined (is not parallel) with respect to the downstream side conveying route D1 and the upstream side conveying route D2.

In the present embodiment, the driven roller 13 is displaced toward the upstream side of the conveying direction of the sheet S, and the driving roller 14 is displaced toward the downstream side of the conveying direction of the sheet S. But, the driven roller 13 and the driving roller 14 may be displaced in a reverse direction.

In this configuration, when the sheet S is conveyed by being sandwiched between the driven roller 13 and the driving roller 14, the sheet S is conveyed in the conveying direction DS along a tangent to the driven roller 13 and the driving roller 14 at the point of contact. Also, the sheet S is conveyed such that the top end of the sheet S contacts the downstream side guiding member 31*a* (upper part of the figure), the back end of the sheet S contacts the upstream side guiding member 32*b* (lower part of the figure), and the locus of the sheet S becomes a sigmoid shape. Therefore, the conveying position of the sheet S can be stabilized while the sheet S is in contact with the guiding members 31*a* and 32*b*.

For a start trigger sensor 11 as a downstream side detection unit and a stop trigger sensor 12 as an upstream side detection unit, an optical sensor that is a transmission type or a reflection type having high accuracy for detecting an end part of the sheet can be used. In the present embodiment, a reflection type optical sensor is used. The smaller the distance between the sensor (11, 12) and the sheet S, the more the detection accuracy improves.

The distance A shown in FIG. 1 is a distance between the start trigger sensor and the contact point of the driven roller 13 and the driving roller 14. The distance B is a distance between the stop trigger sensor 12 and the contact point of the driven roller 13 and the driving roller 14. If the distance A, B is large, the later mentioned pulse count range becomes large. Therefore, it is preferable to set the distance A, B to be as small as possible.

Further, as shown in FIG. 2, in a state where the sheet S contacts the guiding members 31*a* and 32*b* when the sheet S is conveyed by the driven roller 13 and the driving roller 14, it is preferable that the detection position of the start trigger sensor 11 is set between the contact point of the driven roller 13 and the driving roller 14 and the position where the sheet S is in contact with the guiding member 31*a*. Also, it is preferable that the detection position of the stop trigger sensor 12 is provided between the position where the sheet S is in contact with the guiding member 32*b* and the contact point of the driven roller 13 and the driving roller 14 in a state shown in FIG. 2. The reason is that the conveying posture of the sheet S is kept constant in a range where the sheet S is in contact with the guiding member even though the sheet S is placed at a position apart from the pair of rollers 13 and 14, with respect to the position where the sheet S comes in contact with the guiding member for the first time after being output from the pair of rollers 13 and 14, or with respect to a position where the sheet S comes into contact with the guiding member in the upstream side lastly in a state where the sheet S is conveyed by the pair of rollers 13 and 14. In the state shown in FIG. 2, since the conveying posture of the sheet S is kept constant within a range where the sheet S is in contact with the guiding members 31*a* and 32*b*, detection accuracy of the start trigger sensor 11 and the stop trigger sensor 12 can be improved.

In the state shown in FIG. 2, it is preferable that the detection position of the start trigger sensor 11 is set in an area where the sheet S is in contact with the guiding member 31*a*. Also, it is preferable that the detection position of the stop trigger sensor 12 is set in an area where the sheet S is in contact with the guiding member 32*b*. Since the distance between the sensor and the sheet S is kept constant in the areas where the sheet S is in contact with the guiding members 31*a* and 32*b*, the detection accuracy can be improved.

Further, it is preferable to set the detection position of the start trigger sensor 11 at an intersection point of the conveying route D1 and an extension of the conveying direction DS. Also, it is preferable that the detection position of the stop trigger sensor 12 is set at an intersection point of the conveying route D2 and an extension of the conveying direction DS. In this case, the inclination of the pair of the rollers is adjusted such that, by using a sheet of the lowest stiffness among sheets to be used considering use environment (room temperature, hygroscopicity, and the like), a posture of the extension of the conveying direction DS almost agrees with the posture of the sheet S (such that they are linearly arranged). Depending on the stiffness of the sheet, the conveying posture of the sheet may be affected by contact with the guiding member. Even though this is considered, a state is obtained in which the sensor is placed at a position in a side near the pair of rollers 13 and 14 with respect to the contact position between the sheet S and the guiding member. Thus, the distance between the sensor and the sheet becomes almost constant, so that it becomes possible to detect the sheet S more accurately.

More specifically, it is preferable to provide the sensors 11 and 12 at positions where an extension of the conveying direction DS of the sheet S intersects with the guiding members 31 and 32 respectively.

In FIG. 2, assuming that X indicates an intersection point of an extension of the transfer direction DS and the guiding member 31*a*, 32*b*, it is possible to place each of the start trigger sensor 11 and the stop trigger sensor 12 within a range of about X±10 mm, in the conveying direction of the sheet S, considering curl, wave and the like of the sheet S.

Also, in a configuration shown in FIG. 2, it is preferable that the angle θ between the conveying direction DS of the sheet S and the conveying routes D1 and D2 of the sheet S formed by the guiding members 31 and 32 is $\theta=15\pm10°$.

In the present embodiment, the start trigger sensor 11 is provided in an opposite side of the guiding member 31*a* with respect to a side where the sheet S exists, and the stop trigger sensor 12 is provided in an opposite side of the guiding member 32*b* with respect to a side where the sheet S exists, so that detection of the sheet S by the start trigger sensor 11 is performed from an opposite side of the sheet S where the stop trigger sensor 12 performs detection. Each of the sensors 11 and 14 is provided so as to detect passage of the end part of the sheet at a position that is the closest to the sheet S. By adopting such a configuration, the end part of the sheet S can be detected at a position within a range where the conveying position of the sheet S is stable and where the distance of the sensor 11, 12 and the sheet S is the smallest. Thus, measurement accuracy of the conveying distance of the sheet S can be improved.

Sensor windows 35 and 36 are provided at a position of the downstream side guiding member 31*a* corresponding to the start trigger sensor 11, and at a position of the upstream side guiding member 32*b* corresponding to the stop trigger sensor 12 respectively. Each sensor window is formed by a member that transmits light. The start trigger sensor 11 and the stop trigger sensor 12 can detect passage of the end part of the sheet S from the sensor windows 35 and 36 respectively.

Openings may be provided in the guiding members 31 and 32 at positions corresponding to the sensors 11 and 12 respectively. But, in this case, detection accuracy may be deteriorated because paper powder and the like adheres to sensors 11 and 12. Thus it is preferable to provide the sensor windows 35 and 36.

The sheet slides on the surface of the sensor windows 35 and 36. Thus, the paper powder and the like is always removed from the surface of the sensor windows 35 and 36, so that secular deterioration of the detection accuracy of the sensors 11 and 12 can be avoided.

In the present embodiment, for example, the sheet conveying apparatus is configured such that the interval between the downstream side guiding members 31*a* and 31*b* is about 3 mm, the interval between the upstream side guiding members 32*a* and 32*b* is also about 3 mm, and the distance between the sensors 11 and 12 is 40-50 mm. The width of each of the sensor windows 35 and 36 can be about 15 mm similarly to the width of each of the sensors 11 and 12 in the case where the shape of the detection surface of the sensor and the sensor window is a square.

In the present embodiment, the distance 40-50 mm between the sensors 11 and 12 is determined such that the surface pressure to the guiding members falls within a proper range in consideration of the apparatus configuration in which the interval between the upper and lower guiding members is 3 mm, and considering the thickness and stiffness of the sheet S to be used.

By adopting the above-mentioned configuration, the posture of the sheet S can be kept constant when the sheet S is conveyed, and variations of the conveying position can be reduced. Thus, accuracy of a sheet conveying distance calculation (described later) using a detection result of the end part of the sheet S by the sensors 11 and 12 can be improved.

Figure 3:
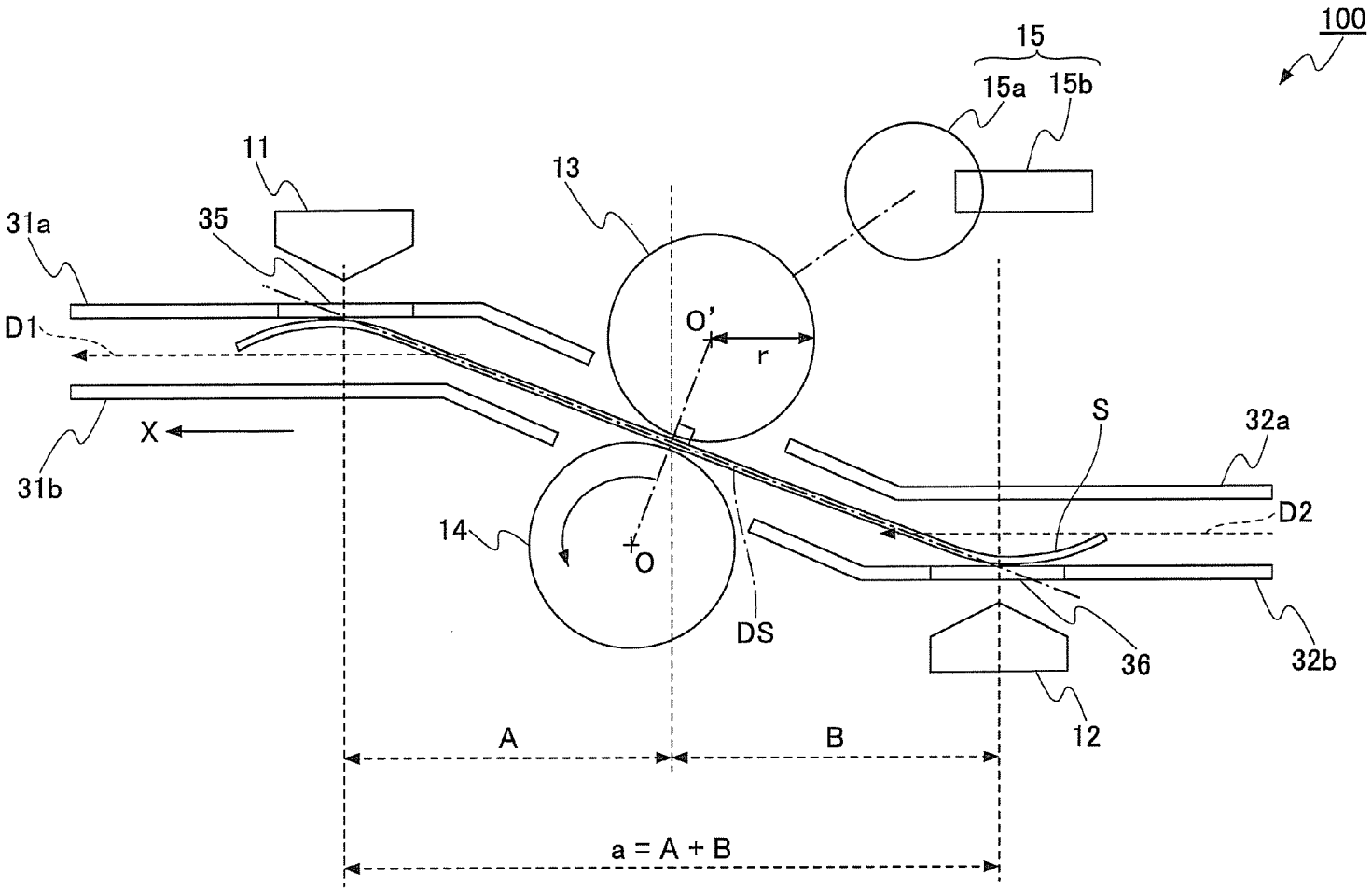
FIG. 3 is a schematic sectional view showing another configuration example of the sheet conveying apparatus of an embodiment.

FIG. 3 shows a schematic section diagram showing another configuration of the sheet conveying apparatus 100 of the present embodiment.

In the example shown in FIG. 3, similarly to the configuration of FIG. 2, the center line connecting between the center O of the driving roller 14 and the center O' of the driven roller 13 is not orthogonal to the conveying routes D1 and D2 of the sheet S formed by the guiding members 31 and 32 that are parallel with each other. That is, the conveying direction DS of the sheet S conveyed by the driven roller 13 and the driving roller 14 is inclined (is not parallel) with respect to the downstream side conveying route D1 and to the upstream side conveying route D2.

Also, the downstream side conveying route S1 and the upstream side conveying route D2 that are in parallel with each other are formed to have a step height. In addition, it is preferable that each of the guiding members 31 and 32 is bent such that an exiting part of the guiding member 32 forming the upstream side conveying route D2 and an entering part of the guiding member 31 forming the downstream side conveying route D1 guide the sheet S along the conveying direction DS (so as to be in parallel with a tangent of a contact point between the driven roller 13 and the driving roller 14).

The length and the angle of the bent part formed in the exiting part of the guiding member 32, and the length and the angle of the bent part formed in the entering part of the guiding member 31 can be properly set in consideration of the thickness, stiffness and the like of the sheet S to be used. Also, as shown in the figure, although the step height is formed such that the conveying route D1 is in the upper part of the figure and the conveying route D2 is in the lower part of the figure, the upper and the lower relationship of the conveying routes D1 and D2 may be reversed. In such a case, the driven roller 13 and the driving roller 14 are placed such that the center line of the driven roller 13 and the driving roller 14 is inclined in a reverse direction.

The step height is provided to the conveying routes D1 and D2 of the upstream side and the downstream side of the conveying direction of the sheet S in order to increase the inclination of the center line of the driven roller 13 and the driving roller 14, so that the positions where the sheet S is in contact with the guiding members 31*a* and 32*b* can be made closer to the driven roller 13 and the driving roller 14. Thus, the conveying posture of the sheet S can be more stable.

In a configuration shown in FIG. 3, it is preferable that the angle θ between the conveying direction DS of the sheet S and the conveying routes D1 and D2 of the sheet S formed by the guiding members 31 and 32 is $\theta=30\pm10°$.

Although, in the present embodiment, the sensors 11 and 12, the driven roller 13 and the driving roller 14 are fixed, positions of them may be configured variable according to the type of the sheet S.

For example, there is a case where the conveying posture varies according to the thickness and the stiffness of the sheet S so that the positions of contact between the sheet S and the guiding members 31*a*, 32*b* are displaced from the positions of the sensors 11 and 12.

Considering such a case, the apparatus may be configured such that the sensor 11, 12 moves to a position at which the sheet S is in contact with the guiding member 31*a*, 32*b* according to the sheet thickness or stiffness, for example. In this case, it is preferable that the sensor window 35, 36 is configured to move with the sensor 11, 12, or that the size of the sensor window 35, 35 is set to be greater than a moving range. Also, the driven roller 13 and the driving roller 14 can be configured to be movable such that the inclination angle of the center line of the driven roller 13 and the driving roller 14 on a section of the conveying direction of the sheet S can be changed.

In such a case, the sheet conveying apparatus 100 may include a table which stores positions of the sensors 11, 12, the driven roller 13 and the driving roller according to characteristics of the sheet S such as the thickness and the stiffness. And, the sheet conveying apparatus 100 may be configured to change arrangement of them based on the table according to the type of the sheet S.

The thickness and the stiffness and the like may be input every time when the type of the sheet S is changed. Also, it is possible to provide a sheet thickness detection sensor in the upstream side with respect to the stop trigger sensor 12 in the conveying direction of the sheet S, and to move the driven roller 13 and the driving roller 14 by referring to the table based on the sheet thickness that is detected automatically.

Figure 4:
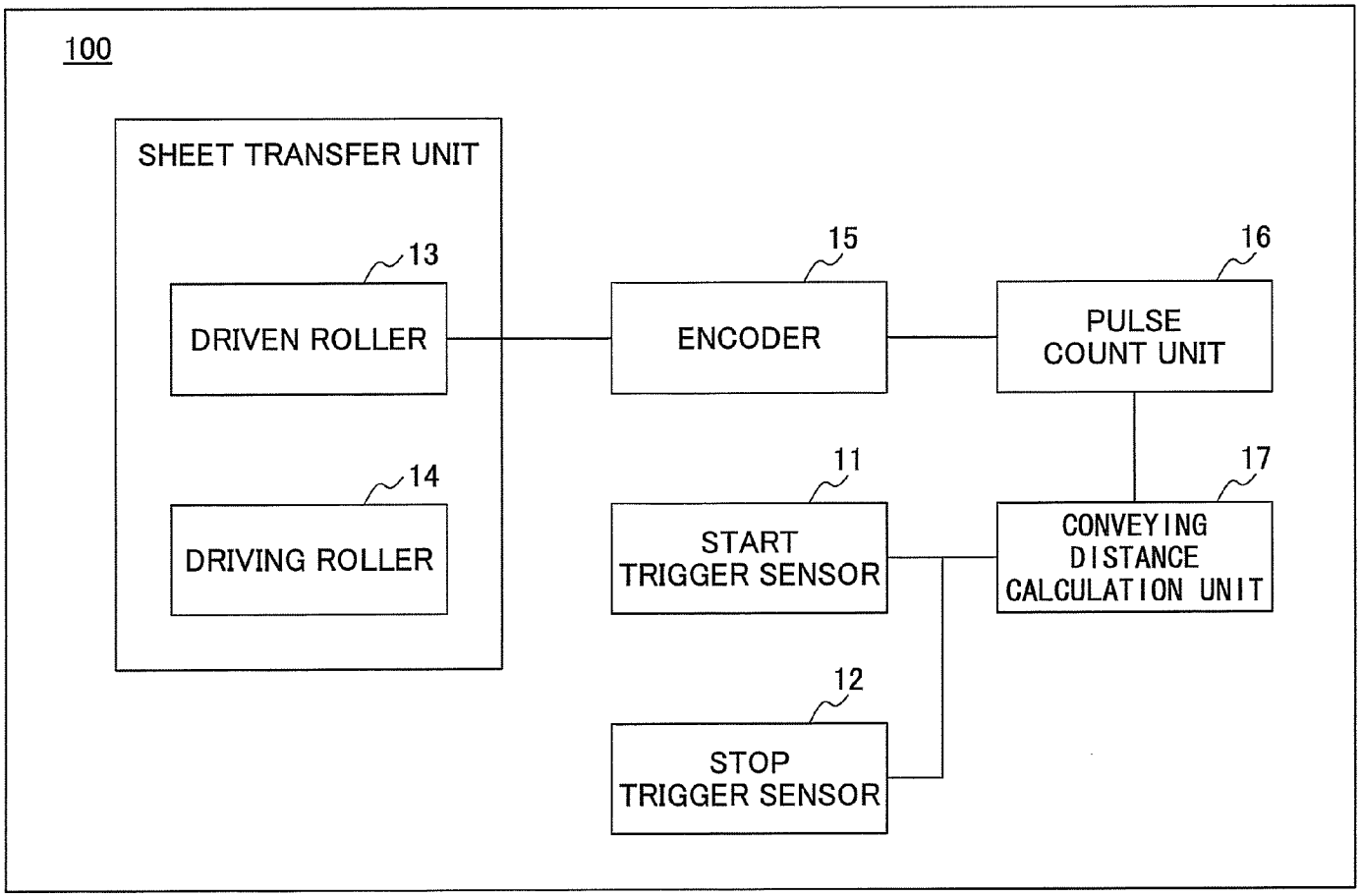
FIG. 4 is a block diagram showing a functional configuration example of the sheet conveying apparatus of an embodiment.

FIG. 4 is a block diagram showing a functional configuration example of the sheet conveying apparatus 100 of the present embodiment.

As shown in FIG. 4, the sheet conveying apparatus 100 includes the driven roller 13 and the driving roller 14 as a sheet transfer unit, the encoder 15, the start trigger sensor 11, the stop trigger sensor 12, a pulse count unit 16, and a conveying distance calculation unit 17.

As mentioned before, the pulse count unit 16 counts a pulse signal to measure a rotation amount of the driven roller 13 as a conveying amount of the sheet, wherein the pulse signal is generated by a rotating encoder disc 15*a* and an encoder sensor 15*b* of the encoder 15 provided in the driven roller 13.

The conveying distance calculation unit 17 calculates the conveying distance of the sheet S conveyed by the sheet conveying unit based on the detection result of the sheet S detected by the start trigger sensor 11 and the stop trigger sensor 12 and the rotation amount of the driven roller 13 measured by the pulse count unit 16.

<Sheet Conveying Distance Calculation Method>

Next, a method for calculating the conveying distance of the sheet S is described. The conveying distance is calculated by the sheet conveying distance calculation unit 17 by using outputs of the start trigger sensor 11 and the stop trigger sensor 12.

As shown in FIG. 2, in a case where the driving roller 14 rotates in a direction of arrow and the sheet S is not conveyed (in idle running), the driven roller 13 is driven by the driving roller 14. In a case where the sheet S is transferred, the driven roller 13 rotates by being driven by the sheet S. When the driven roller 13 rotates, a pulse is generated from the rotary encoder 15 provided on the rotation axis.

When sheet S is transferred to an arrow X direction and the start trigger sensor 11 detects that a top end part passes, the pulse count unit 16 starts pulse counting of the rotary encoder 15. When the stop trigger sensor 12 detects that a rear end part of the sheet S passes, the pulse count unit 16 ends pulse counting.

Figure 5:
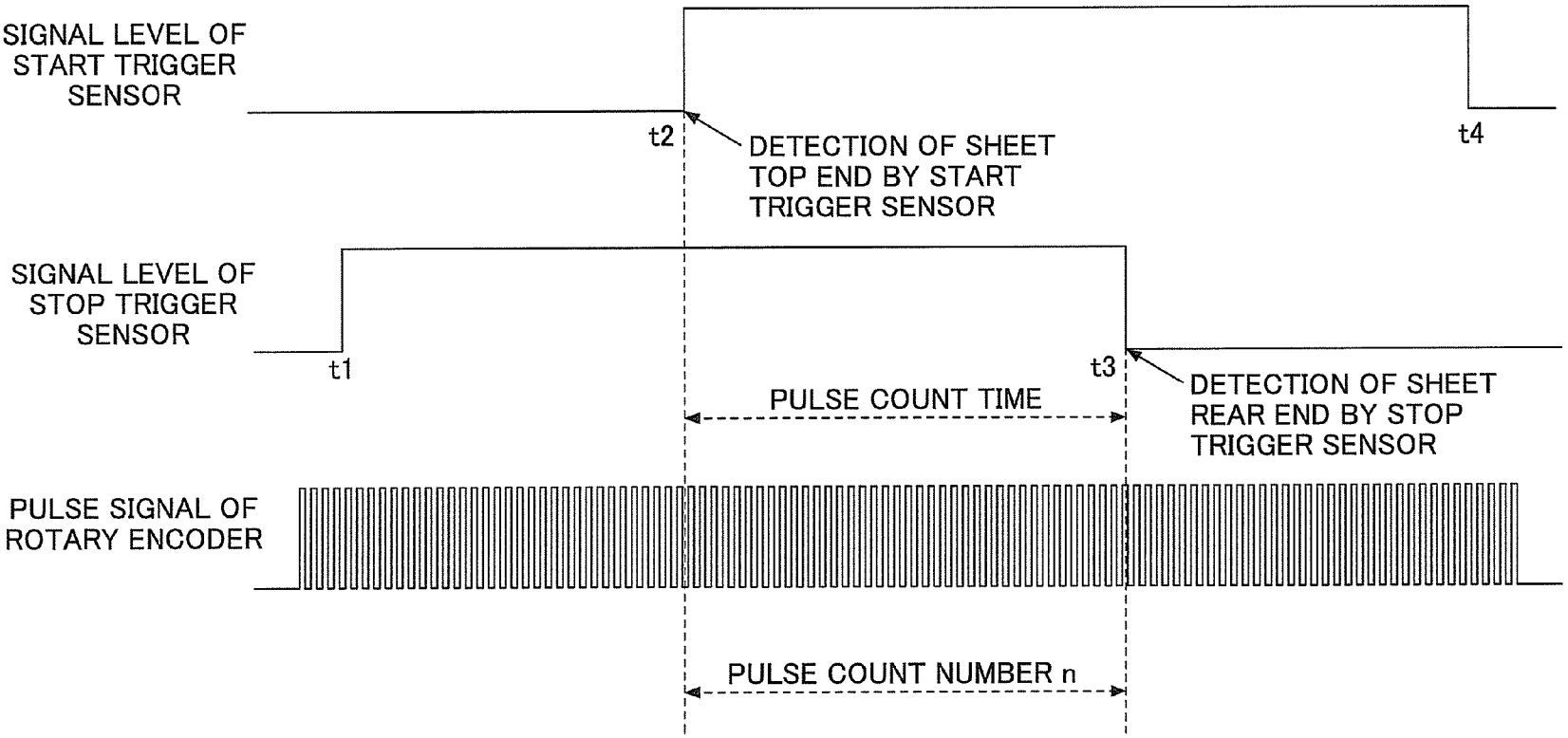
FIG. 5 is a diagram showing an output example of a start trigger sensor, a stop trigger sensor, and a rotary encoder of an embodiment.

FIG. 5 shows an output example of the start trigger sensor 11, the stop trigger sensor 12, and the rotary encoder 15.

As described before, when the driven roller 13 starts rotation, a pulse occurs from the rotary encoder 15 provided on the rotation axis of the driven roller 13.

The sheet S is conveyed, and after the stop trigger sensor 12 detects passage of the top end part of the sheet S at a time t1, the start trigger sensor 11 detects passage of the top end part of the sheet S at a time t2.

Next, after the stop trigger sensor 12 detects passage of the rear end part of the sheet t3 at a time t3, the start trigger sensor 11 detects passage of the rear end part of the sheet S at a time t4.

At this time, the pulse count unit 16 counts the pulse of the rotary encoder 15 from the time t2 when the start trigger sensor 11 detects passage of the top end part of the sheet S to the time t3 when the stop trigger sensor 12 detects passage of the rear end part of the sheet S.

It is assumed that r indicates a radius of the driven roller 13 where the rotary encoder 15 is provided, N indicates the number of encoder pulses of one rotation of the driven roller 13, and n indicates the number of pulses counted during the pulse count time. In this case, the conveying distance L of the sheet S can be obtained by the following equation (1).

$$L=(n/N)\times 2\pi r \quad (1)$$

n: counted number of pulses

N: the number of encoder pulses of one rotation of the driven roller 13 [/r]

r: radius [mm] of the driven roller 13

Generally, the sheet conveying speed varies according to outer shape accuracy of the roller (especially, the driving roller) conveying the sheet S, mechanical accuracy such as axis deviation accuracy, rotation accuracy of motor, accuracy of power transmission mechanism such as gear, belt and the like. Further, the sheet conveying speed varies according to slip between the driving roller 14 and the sheet S, and according to slack due to difference of sheet conveying power or sheet conveying speed between the upstream side and the downstream side of the conveying unit. Thus, the pulse period and the pulse width of the rotary encoder 15 always vary. But, the number of pulses does not change.

Therefore, the conveying distance calculation unit 17 of the sheet conveying apparatus 100 can calculate the conveying distance L of the sheet S conveyed by the driven roller 13 and the driving roller 14 by using the equation (1) without depending on the sheet conveying speed.

Also, the conveying distance calculation unit 17 can obtain a relative ratio such as a ratio between pages of the sheet S, and a ratio between front and back and the like, for example.

The conveying distance calculation unit 17 can obtain an expansion and contraction ratio R by using the following equation (2) based on a relative ratio of the sheet conveying distance between before and after heat fixing of an electrophotographic method, for example.

$$R=[(n2/N)\times 2\pi r]/[(n1/N)\times 2\pi r] \quad (2)$$

n1: the number of pulses counted when conveying the sheet S before heat fixing n2: the number of pulses counted when conveying the sheet S after heat fixing.

An example of calculation in the present embodiment is described as follows.

In the present embodiment, the conveying distance L1 of the sheet S is calculated as follows assuming that N=2800[/r], r=9 [mm], and the number of pulses counted when a sheet of A3 size is vertically conveying.

$$L1=(18816/2800)\times 2\pi\times 9=380.00 \text{ [mm]}$$

Also, a conveying distance L2 of the sheet S is as follows when the number of pulses counted again after heat fixing is n2=18759[/r].

$$L2=(18759/2800)\times 2\pi\times 9=378.86 \text{ [mm]}$$

Thus, difference of the conveying distance of the sheet S between front and back of the sheet is $$\Delta L=380.00-378.86=1.14 \text{ [mm]}.$$

Thus, based on the difference of the conveying distance of the sheet S, the expansion and contraction ratio R of the sheet S (relative ratio of length of front and back of the sheet S) can be obtained as $$R=378.86/380.00=99.70[\%].$$

In this case, the length of the sheet S contracts in the conveying direction by about 1 mm. Thus, if the image length is the same between front and back of the sheet S, front-to-back misregistration of about 1 mm occurs. Therefore, the front-to-back registration accuracy can be improved by correcting the length of an image to be printed on the back side of the sheet S based on the calculated expansion and contraction ratio R.

In the above-mentioned example, although the expansion and contraction ratio R is obtained by calculating the conveying distances L1 and L2 of the sheet S before and after heat fixing, an expansion and contraction ratio calculation unit may be provided for obtaining a ratio between the numbers $n_1$ and $n_2$ of pulses calculated when conveying the sheet S before and after heat fixing, as the expansion and contraction ratio R.

For example, in the above example, when the number of pulses calculated when conveying the sheet S before heat fixing is $n_1$=18816, and the number of pulses calculated when conveying the sheet S after heat fixing is $n_2$=18759, the expansion and contraction ratio R can be obtained as follows.

$$R=n_2/n_1=18759/18816=99.70[\%]$$

By adding the distance a between the start trigger sensor 11 and the stop trigger sensor 12 shown in FIG. 2 to the sheet conveying distance L obtained by the equation (1), the length $L_p$ of the sheet S in the conveying direction can be obtained.

$$L_p=(n/N)\times 2\pi r+a \quad (3)$$

a: distance between the start trigger sensor 11 and the stop trigger sensor 12

As mentioned above, the conveying distance calculation unit 17 of the sheet conveying apparatus 100 can obtain the length of the sheet S in the conveying direction by the equation (3) for adding the distance a between the sensors to the conveying distance L of the sheet S conveyed by the sheet conveying unit obtained by the equation (1).

Also, the conveying distance calculation unit 17 can obtain the expansion and contraction ratio R using the following equation (4) based on the relative ratio of the length $L_p$ of the sheet S in the conveying direction between before and after heat fixing by the electrophotographic scheme.

$$R=[(n2/N)\times 2\pi r+a]/[(n1/N)\times 2\pi r+a] \quad (4)$$

Accordingly, the conveying distance calculation unit 17 of the sheet conveying apparatus 100 can calculate the expansion and contraction ratio R by obtaining the length $L_p$ of the sheet S in the conveying direction accurately.

According to the present embodiment, variations of conveying positions of the sheet S can be reduced, and the passage of the end part can be accurately detected while the distance between the sheet S and the start trigger sensor 11/the stop trigger sensor 12 is always constant. Thus, it becomes possible to enhance accuracy of calculation of the sheet conveying distance.

<Configuration of the Image Forming Apparatus>

Figure 6:
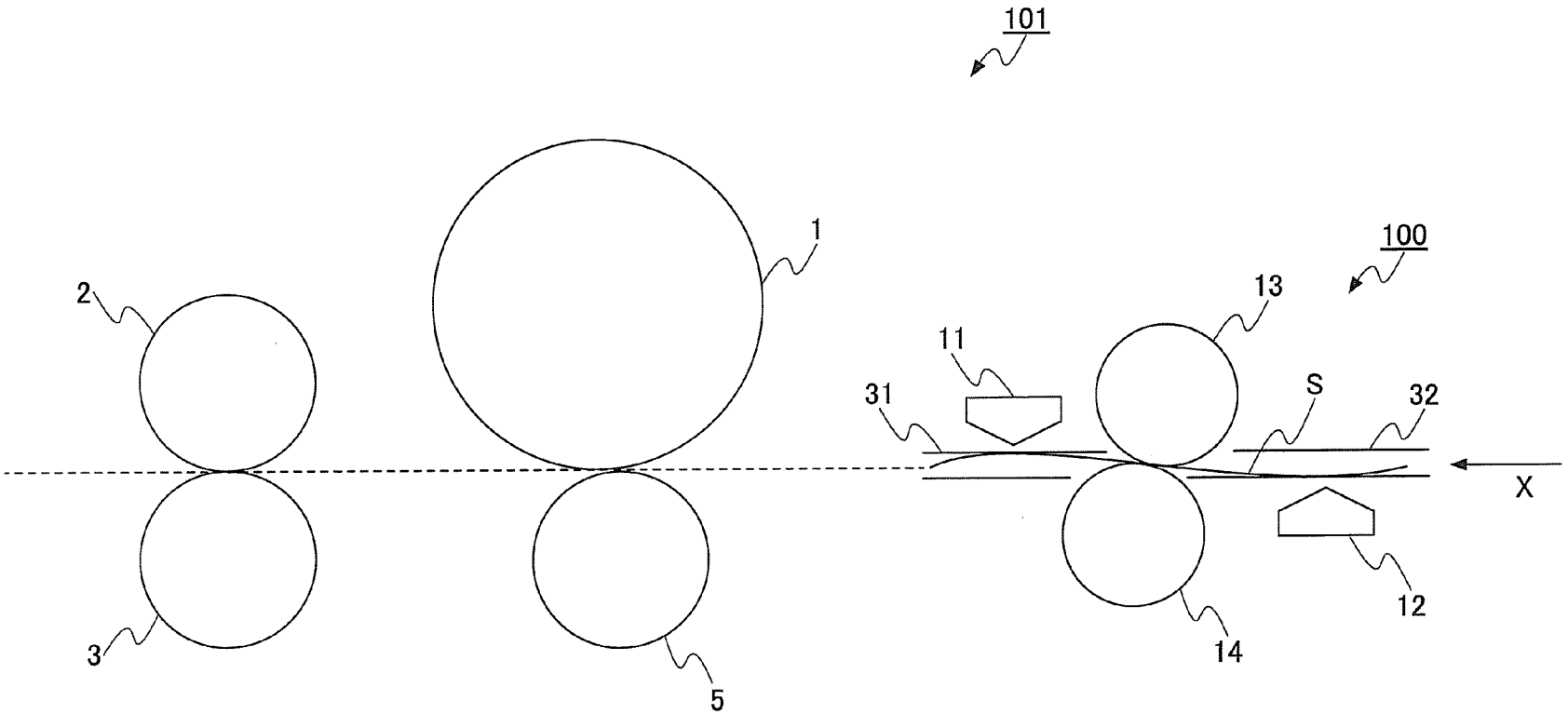
FIG. 6 is a diagram (1) showing a configuration example of an image forming apparatus of an embodiment.
Figure 7:
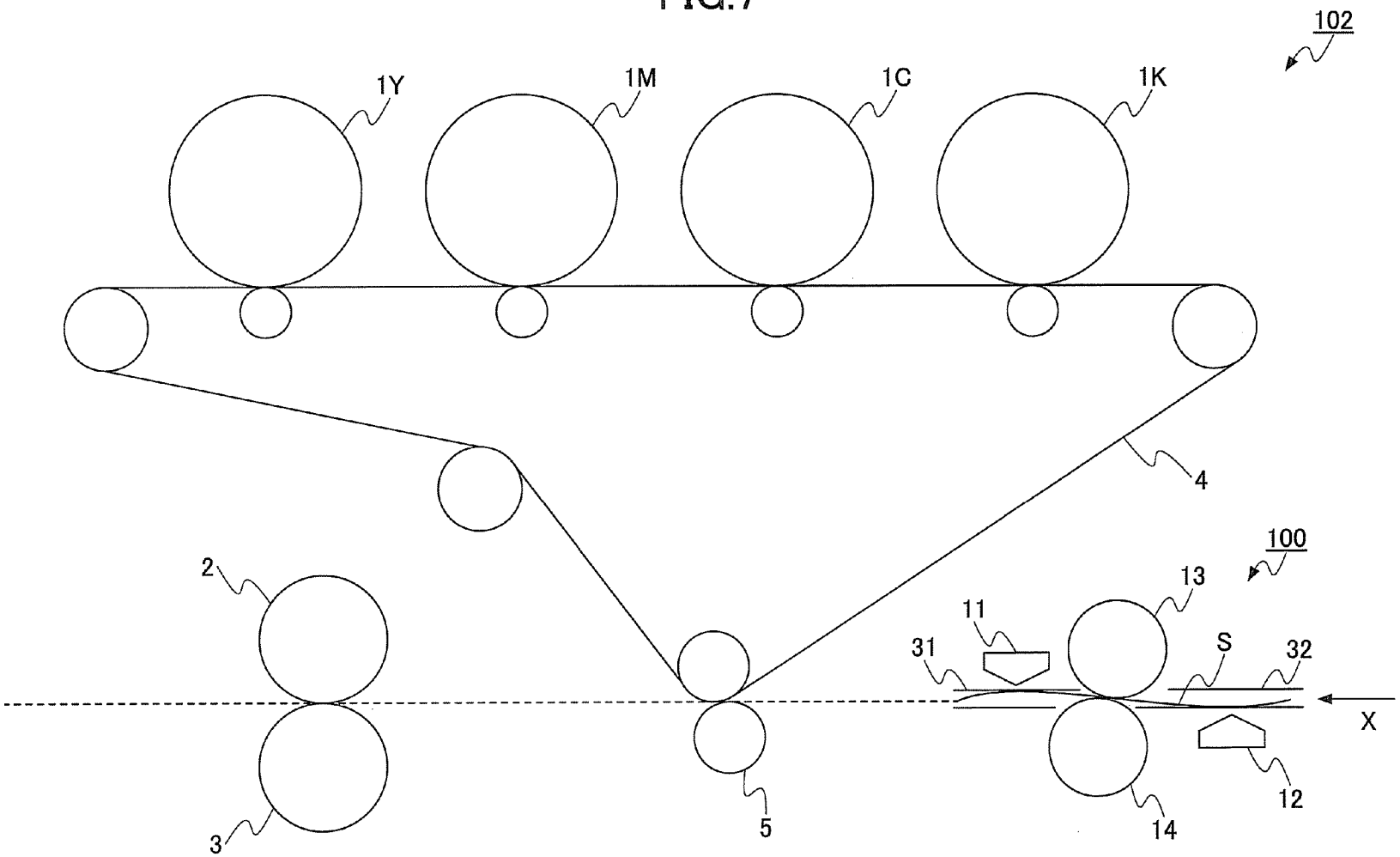
FIG. 7 is a diagram (2) showing a configuration example of an image forming apparatus of an embodiment.

FIGS. 6 and 7 show configuration examples of image forming apparatuses including the sheet conveying apparatus 100 of the present embodiment. FIG. 6 shows an example of a monochrome image forming apparatus 101, and FIG. 7 shows an example of a tandem type color image forming apparatus 102.

In the monochrome image forming apparatus 101 shown in FIG. 6, when printing an image on the sheet to be transferred, an electrostatic latent image is formed on a surface of a photoreceptor drum 1 that is evenly electrically charged and that rotates by an optical writing unit (not shown in the figure) . Next, the image appears as a toner image by a developing unit (not shown in the figure). Next, the toner image on the photoreceptor drum 1 is transferred to the sheet S between the photoreceptor drum 1 and an image transfer unit 5. After that, the toner image is melted and fixed on the sheet S while the sheet S passes between a heat applying roller 2 and a pressure applying roller 3, so that a print image is formed.

In the tandem color mage forming apparatus 102 shown in FIG. 7, toner images that are formed on photoreceptor drums 1Y-1K, provided for black (K), cyan (C), yellow (Y) and magenta (M), are initially transferred on an intermediate image transfer belt 4 where the toner images are overlapped. After that, the toner images are secondary transferred on the sheet S that is carried between the intermediate image transfer belt 4 and the transfer unit 5. The sheet S on which the color toner image is transferred is still conveyed, and passes between the heat applying roller 2 and the pressure applying roller 3, so that a print image is formed on the sheet S.

According to the image forming apparatuses 101 and 102 shown in FIGS. 6 and 7, the sheet conveying apparatus 100 is provided right before the transfer unit 5 on the conveying route of the sheet S. Also, in image forming apparatuses of other configurations, the sheet conveying apparatus 100 is placed right before the transfer unit, so that the length of the sheet S in the conveying direction can be measured right before image transfer.

In the image forming apparatuses 101 and 102, the sheet conveying apparatus 100 measures the length of the sheet S in the conveying direction first. After that, the toner image is transferred on the sheet S by the transfer unit. Then, the sheet S passes between the heat applying roller 2 and the pressure applying roller 3, so that a print image is formed on one surface of the sheet S.

When performing two-sided printing, the sheet S is turned around (from front to back) by a turn-around mechanism (not shown in the figure), and the sheet S is conveyed again to the arrow direction shown in the figure. In this case, the sheet S is heated once, so that the sheet Size is contracted in general, and the contracted sheet S is conveyed. The sheet conveying apparatus 100 measures the conveying distance or the sheet length again. After that, the toner image is transferred on the back side, and fixed.

The toner image for the back side is transferred to the sheet S in a state in which the image length has been corrected based on the calculated front-back ratio of the conveying distance (image scaling correction). Thus, the length of the front image agrees with the length of the back image on the sheet S, so that front-to-back registration accuracy can be improved.

Contraction of the sheet S after fixing changes toward a direction of recovery as time advances. Thus, by measuring the conveying distance or the length in the conveying direction right before the transfer unit 5, it becomes possible to obtain front-back ratio of the sheet length more accurately and to enhance the front-to-back registration accuracy.

According to the image forming apparatuses 101 and 102 including the sheet conveying apparatus 100 of the present embodiment, it becomes possible to perform printing on the sheet S with high front-to-back registration accuracy.

Figure 8:
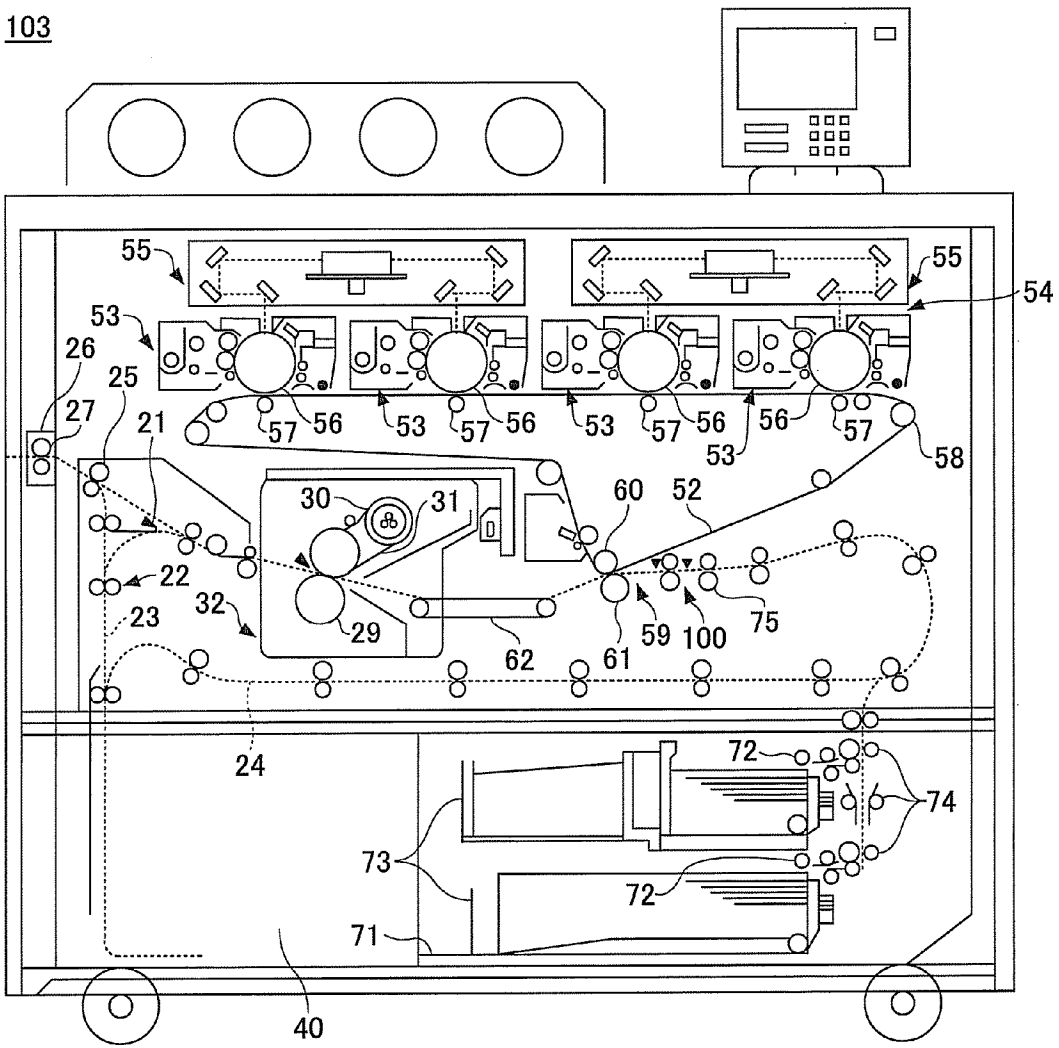
FIG. 8 is a diagram (3) showing a configuration example of an image forming apparatus of an embodiment.

FIG. 8 shows a configuration example of an image forming apparatus 103 of the present embodiment.

The image forming apparatus 103 includes an intermediate transfer belt 52 like an endless belt near the center. The intermediate transfer belt 52 is looped over plural supporting rollers so that the intermediate transfer belt 52 can rotate in a clockwise direction in the figure. A plurality of image forming units 53 are arranged laterally on the intermediate transfer belt 52 along the conveying direction, so that a tandem image forming apparatus 54 is formed. A light exposure apparatus 55 is provided on the tandem image forming apparatus 54.

Each image forming unit 53 of the tandem image forming apparatus 54 includes a photoreceptor drum 56 as an image carrier for carrying each color of toner images.

In a primary transfer position for transferring the toner image from the photoreceptor drum 56 to the intermediate transfer belt 52, an primary transfer roller 57 is provided such that the transfer roller 57 is opposed to the photoreceptor drum 56 in which the intermediate transfer belt 52 is sandwiched between the primary transfer roller 57 and the photoreceptor drum 56. Also, the supporting roller 58 is a driving roller for driving and rotating the intermediate transfer belt 52.

In an opposite side of the tandem image forming apparatus 54 across the image transfer belt 52 (in the downstream side of the conveying direction of the intermediate transfer belt 52), a secondary transfer apparatus 59 is provided. The secondary transfer apparatus 59 transfers the image on the intermediate transfer body 52 to the sheet S by pushing the secondary transfer roller 61 to the secondary transfer opposite roller 60 to apply transfer electric field. The secondary transfer apparatus 59 changes transfer current of the secondary transfer roller 61 that is a parameter of a transfer condition according to the sheet S.

In the upstream side of the sheet S in the conveying direction of the secondary transfer apparatus 59, the sheet conveying apparatus 100 is provided. In the downstream side, a fixing apparatus 32 is provided for heat-melting and fuxing the transferred image (toner image) on the sheet S. The sheet conveying apparatus 100 measures the sheet conveying distance or the length in the sheet conveying direction before and after passing the fixing apparatus 52 when performing two-sided printing. The image forming apparatus 103 performs scaling correction of the image in the back side of the sheet S based on the expansion and contraction ratio calculated from the measurement results. In the present embodiment, the sheet conveying apparatus 100 is placed in the upstream side of the conveying direction of the secondary transfer apparatus 59 and in the downstream side of a resistance roller 75.

The fixing apparatus 32 includes a halogen lamp 30 as a heat source, and is configured such that the pressure applying roller 29 is pushed to the fixing belt 31 that is an endless belt. The fixing apparatus 32 changes temperature of the fixing belt 31 and the pressure applying roller 29, nip width between the fixing belt 31 and the pressure applying roller 29, and speed of the pressure applying roller 29, that are parameters of the fixing condition, according to the sheet S. The sheet S on which the image has been transferred is conveyed by a conveying belt 62 to the fixing apparatus 32.

When the image data is sent to the image forming apparatus 103 and the image forming apparatus 103 receives a signal of start of image creation, a driving motor (not shown in the figure) drives and rotates the supporting roller 58 so that other supporting rollers are driven and the intermediate transfer belt is conveyed by rotation. At the same time, each image forming unit 53 forms a respective single color image on the photoreceptor drum 56. Then, with the conveyance of the intermediate transfer belt 52, the single color images are sequentially transferred by the transfer part 57 so that superimposed color image is formed on the intermediate transfer body 52.

Also, one of paper feed rollers of the paper feed table 71 is selectively rotated, so that the sheet S is output from one of the paper feed cassettes 73, and the sheet S is conveyed by the conveying roller 74, and the sheet S goes to the resistance roller 75 and stops. Then, the resistance roller 75 is rotated in synchronization with the timing of the superimposed color image on the intermediate transfer belt 52, and the secondary transfer apparatus 59 performs image transfer so as to record a color image on the sheet S. The sheet S after the image transfer is conveyed to the fixing apparatus 32 by the secondary transfer apparatus 59. After the transferred image is melted and fixed by applying heat and pressure, the sheet S is conveyed to a sheet reverse route 23 and a two-sided transfer route 24 by a branch hook 21 and a flip roller 22 in the case of two-sided printing, so that the superimposed color image is recorded on the backside of the sheet S using the above-mentioned method.

In the case when the sheet S is reversed, the sheet S is conveyed to the sheet reverse route 23 by the branch hook 21, and the sheet S is conveyed to the side of a paper ejecting roller 25 by the flip roller 22, so that the front side and the back side of the sheet S are reversed.

In the case of a single-sided printing and no sheet reversal, the sheet S is conveyed to the paper ejecting roller 25 by the branch hook 21.

After that, the sheet S is conveyed to a decurler unit 26 by the ejecting roller 25. The decurler unit 26 changes a decurler amount according to the sheet S. The decurler amount is adjusted by changing the pressure of the decurler roller 27, and the sheet S is ejected by the decurler roller 27. A purge tray 40 is placed under the reverse paper ejecting unit.

<Image Scaling Correction Based on Sheet Conveying Distance>

The sheet conveying apparatus 100 measures the conveying distance or the length of the conveying direction of the sheet S by the method described before. The length (width) of the width direction perpendicular to the conveying direction of the sheet S can be obtained by measuring positions of a front side edge and a back side edge of the sheet S (end parts of the sheet width direction) by using a CIS (contact image sensor).

After the sheet conveying apparatus 100 and the CIS measure sheet sizes such as the conveying distance or the length in the conveying direction, and the sheet width, the toner image is transferred to the sheet S by the secondary transfer apparatus 59. The sheet S on which the toner image has been transferred is transferred to the fixing apparatus 32 so that the toner image is fixed. There is a case where the sheet S is contracted due to heat from when the sheet S passes through the fixing apparatus 32.

After that, the sheet S is transferred to the sheet conveying apparatus 100 again after the sheet S is turned around by the sheet reverse route 23. After the sheet Size is measured, the toner image is transferred on the back side and the toner image is fixed.

Regarding a toner image of a following sheet S, the image size and the image position are corrected (image scaling correction) based on the measured front and back ratio of the sheet size. As a result, the image size printed on the front of the sheet S agrees with the image size printed on the back of the sheet S, so that front-to-back registration accuracy improves.

The above-mentioned contraction of the sheet S after fixing changes toward a direction of recovery as time advances. Therefore, for enhancing the front-to-back registration accuracy, it is advantageous to measure the sheet conveying distance or the length in the sheet conveying direction right before the toner image is transferred and to obtain the sheet length ratio between front and back more accurately.

Next, a process procedure for image scaling correction based on the sheet size measured in the sheer conveying apparatus 100 is described. As mentioned before, in the present embodiment, the sheet conveying apparatus 100 is placed right before the secondary transfer apparatus 59 (upstream of the sheet S conveying direction). Thus, the measured sheet size is reflected in exposure data size and exposure timing of a following sheet $S_f$ instead of the sheet S for which the sheet size has been measured.

The exposure apparatus 55 includes a data buffer part, an image data generation part, an image scaling correction part, a clock generation part, and a light emitting device. The data buffer part is formed by a memory and the like, and buffers input image data. The image data generation part generates image data for image formation. The image scaling correction part performs image scaling correction in the sheet conveying direction based on the sheet size information. The clock generation part generates a writing clock. The light emitting device irradiates the photoreceptor drum 56 with light so as to form an image.

The data buffer part buffers input image data transmitted from a host apparatus (not shown in the figure) such as a controller with a transfer clock.

The image data generation part generates image data based on the writing clock from the clock generation part and pixel insertion and removal information from the image scaling correction part. Drive data output from the image data generation part performs ON/OFF control of the light emitting device using the length of one period of the writing clock as one pixel of image formation.

The image scaling correction part generates an image scaling switching signal for performing image scale switching based on the sheet size information measured by the sheet conveying apparatus 100.

The clock generation part operates with high frequency of a plurality of times of the writing clock in order to be able to change clock period and to perform image correction such as pulse width modulation. The clock generation part generates a writing clock with a frequency according to the apparatus speed basically.

The light emitting device is formed by one or a plurality of a semiconductor laser, semiconductor laser array, a surface emitting laser and the like. The light emitting device irradiates the photoreceptor drum 56 with light according to drive data so as to form an electrostatic latent image.

The image before fixing formed by the toner image on the sheet S is fixed by applying heat and pressure in the fixing apparatus 32. At the time, the sheet S is deformed due to the heat and the pressure. Thus, there is a case where the length of the sheet in the conveying direction changes by expansion or contraction. As a result, difference occurs between the image forming position on the backside of the sheet S and the image forming position on the front side, which affects image quality of an output image and registration accuracy (the front side is deformed so that the front side does not agree with the back side). The fixing apparatus 32 may apply heat and pressure separately instead of the heat/pressure applying like the present embodiment. Or, the fixing apparatus may perform flash fixing and the like.

For this reason, the image scaling is corrected according to the measured sheet size, and the writing position is changed in order to form an image such that the deformation of the sheet S by the fixing apparatus 32 is cancelled. As a result, although the sheet S is deformed, images of high front-to-back registration accuracy can be printed on the sheet S.

The sheet size including the deformation of the sheet S can be obtained from the sheet conveying apparatus 100. Depending on the form of deformation of the sheet S, it is possible to perform correction combining scale-up and scale-down instead of only scale-up or only scale-down.

In the case of two-sided printing, when the toner image is fixed on a front side of the sheet S from one top end of the sheet S, the sheet S deforms. After that, the sheet S is turned around by the sheet reverse route 23 in the image forming apparatus 103. At that time, the top end of the sheet entering the fixing apparatus 32 is changed to another top end part which is different from the top end when printing the image on the front side. At this time, if image position correction is not performed, when the sheet s (output from the fixing apparatus 32) is viewed from the upside (from the back surface), the rear end of the output image after fixing is shifted with respect to the rear end of the output image after fixing on the front on which the image was formed before. Thus, registration accuracy deteriorates.

In contract, by performing correction of the image scaling and image forming position when performing image formation on the backside of the sheet S, the front-to-back registration accuracy of the sheet S improves.

<Relationship of Rim Speed of Rollers of the Secondary Transfer Apparatus and the Sheet Conveying Apparatus>

Next, relationship of rim speed of rollers of the secondary transfer apparatus 59 and the sheet conveying apparatus 100 is described, in which the rollers are the secondary transfer opposite roller 60 and the secondary transfer roller 61 of the secondary transfer apparatus 59, and the driven roller 13 and the driving roller 14 of the sheet conveying apparatus 100.

The sheet conveying apparatus 100 includes the driven roller 13, the driving roller 14, a motor as a driving unit of the driving roller 14, and a unidirectional clutch provided between the driving roller 14 and the motor.

The driving roller 14 rotates by receiving driving force of the motor via a driving mechanism, and the driven roller 13 is driven and rotated while sandwiching the sheet P between the driven roller 13 and the driving roller 14.

The unidirectional clutch provided between the driving roller 14 and the motor transmits the driving force produced by the motor in a rotation direction for conveying the sheet. In the direction opposite to the conveying direction of the sheet S, the unidirectional clutch interrupts the driving force to the driving roller 14.

The sheet conveying apparatus 100 receives the sheet S from the resistance roller 75. The driving roller 14 rotates at a predetermined rim speed so as to convey the sheet S with the driven roller 13 at a predetermined conveying speed such that a top end of the sheet S enters the secondary transfer apparatus 59 at a predetermined timing.

The secondary transfer apparatus 59 receives the sheet S from the sheet conveying apparatus 100, and conveys the sheet S further. The secondary transfer apparatus 59 transfers the toner image on the surface of the sheet S. The secondary transfer apparatus 59 includes the intermediate transfer belt 52, the secondary transfer roller 61, a motor that drives the intermediate transfer belt 52 and the secondary transfer roller 61 independently, and a torque limiter provided between the secondary transfer roller 61 and the motor.

The torque limiter provided between the secondary transfer roller 61 and the motor transmits the driving force of the motor to the secondary transfer roller 61 within a range of a limited load torque. The torque limiter slips when the load torque exceeds a predetermined value so as to interrupt the driving force to the secondary transfer roller 61 from the motor.

The secondary transfer apparatus 59 may be provided with a contact and separation mechanism such that the driven roller 13 and the driving roller 14 are separated in a time other than the time for conveying the sheet S. The contact and separation mechanism may be provided so as to separate the driven roller 13 and the driving roller 14 when not conveying the sheet S (interval time between sheet conveying and next sheet conveying, for example), and to bring the driven roller 13 and the driving roller 14 in contact with one another right before conveying the sheet S.

The sheet conveying apparatus 100 outputs a driving force in order to drive and rotate the motor connected to the driving roller 14 at a rim speed of Va. While the sheet S is conveyed only by the sheet conveying apparatus 100, the unidirectional clutch transmits the driving force of the motor to the driving roller 14 and the driving roller 14 rotates at the rim speed of Va, so that the sheet S is conveyed at the speed of Va.

In the secondary transfer apparatus 59, the intermediate transfer belt 52 rotates at a rim speed of Vb (≥Va). The motor connected to the secondary transfer roller 61 outputs a driving force for driving and rotating the secondary transfer roller 61 at a rim speed of Vc (≥Vb).

The slip torque Ts of the torque limiter provided between the secondary transfer roller 61 and the motor is set to be a value Ts between the load torque To when the intermediate transfer belt 52 and the secondary transfer roller 61 are separated and a load torque Tc when the intermediate transfer belt 52 and the secondary transfer roller 61 are in contact with each other (Ts(To<Ts<Tc)).

Therefore, in a state where the secondary transfer roller 61 is separated from the intermediate transfer belt 52, the load torque To of the torque limiter is less than the slip torque Ts. Thus, the torque limiter 42 transmits the driving force of the motor to the secondary transfer roller 61, so that the secondary transfer roller 61 rotates at the rim speed of Vc. In a state where the secondary transfer roller 61 is in contact with the intermediate transfer belt 52, the load torque Tc of the torque limiter exceeds the slip torque Ts. Thus, the torque limiter 42 interrupts the driving force from the motor 33 so that the secondary transfer roller 61 follows the intermediate transfer belt 52 and rotates at the rim speed of Vb.

In these settings, in a state where the sheet S is conveyed by both of the sheet conveying apparatus 100 and the secondary transfer apparatus 59, the sheet S is conveyed at the rim speed Vb of the intermediate transfer belt 52, and the unidirectional clutch of the sheet conveying apparatus 100 becomes idle so that the driving force from the motor to the driving roller 14 is interrupted. Therefore, in this state, the driving roller 14 rotates by being driven by the sheet S at the speed Vb with the driven roller 13.

By adopting such a configuration, the sheet S is conveyed at a constant speed Vb according to the rim speed Vb of the intermediate transfer belt 52 while the sheet S is received from the sheet conveying apparatus 100 to the secondary transfer apparatus 59 and the toner image is transferred to the sheet S. Therefore, since the sheet conveying speed at the time of toner transferring is kept constant, occurrence of abnormal image such as banding can be prevented, so that the image forming apparatus 103 can form an even image.

The above-mentioned effect can be obtained when the rim speed Va of the driving roller 14 of the sheet conveying apparatus 10, the rim speed Vb of the intermediate transfer belt 52 and the rim speed Vc of the secondary transfer roller 61 satisfy the following formula (5).

$$Va \leq Vb \leq Vc \tag{5}$$

When the difference between rim speeds Va and Vb and the difference between rim speeds Vb and Vc are large, the slip amount of the unidirectional clutch and the torque limiter becomes large when conveying the sheet S, so that the life time of the unidirectional clutch and the torque limiter decreases due to heat and abrasion. Thus, it is preferable that each difference is small, and it is more preferable that the rim speeds are set to be the same. However, when each rim speed of the driving roller 14, the intermediate transfer belt 52 and the secondary transfer roller 61 varies due to environmental variation such as temperature and humidity variation, so that the relationship of the formula (5) does not hold true, there is a fear that image expansion and contraction may occur on the sheet S since the conveying speed of the sheet S changes when transferring the toner image. Therefore, it is preferable to set a predetermined margin between rim speeds Va and Vb and between rim speeds Vb and Vc.

Thus, it is preferable that the rim speeds Va, Vb and Vc satisfy the following formulas (6) and (7).

$$0.90Vb \leq Va \leq 0.99Vb \tag{6}$$

$$1.001Vb \leq Vc \leq 1.05Vb \tag{7}$$

Further, it is preferable that the rim speeds Va, Vb and Vc satisfy the following formulas (8) and (9) in order to avoid deterioration of life length of the unidirectional clutch and the torque limiter and to obtain the above-mentioned effect stably considering environmental changes and the like.

$$0.95Vb \leq Va \leq 0.99Vb \tag{8}$$

$$1.001Vb \leq Vc \leq 1.02Vb \tag{9}$$

According to the configuration describe above, it becomes possible to keep the sheet conveying speed constant when transferring the toner image to the sheet S, and it becomes possible that the image forming apparatus 103 forms an even image on the sheet S while preventing occurrence of abnormal image such as banding.

Even through the image forming apparatus is configured to directly transfer toner image to the sheet S from the photoreceptor drum, the sheet conveying speed when transferring the toner image can be kept constant like the present embodiment. In this case, similar effects can be obtained by using a configuration in which the intermediate transfer belt 52 of the present embodiment is replaced with a photoreceptor drum, and the secondary transfer roller 61 is replaced with a transfer roller for transferring an image to the sheet S between the photoreceptor drum and the transfer roller.

Also, a torque limiter may be provided instead of the unidirectional clutch between the driving roller 14 and the motor in the sheer carrying apparatus 100. In the torque limiter, a stop torque is set such that the driving roller 14 rotates by being driven by the sheet S when the sheet conveying apparatus 100 and the intermediate transfer belt 52 convey the sheet S.

<Summary>

As described above, according to the sheet conveying apparatus 100 of the present embodiment, variations of conveying positions of the sheet S can be suppressed using a simple structure, so that the conveying distance of the sheet S can be calculated accurately.

Also, according to the image forming apparatuses 101 and 102 including the sheet conveying apparatus 100 of the present embodiment, the conveying distance of the sheet S can be calculated with high accuracy. Thus, it becomes possible to perform printing with high front-to-back registration accuracy.

Although embodiments are described using concrete examples, the present invention is not limited to these embodiments, but various variations and modifications may be made without departing from the broad principle and the scope of the present invention. That is, the present invention should not be limited by the detailed description of the embodiments and the drawings.

What is claimed is:

1. A sheet conveying apparatus, comprising:

a sheet conveying unit configured to convey a sheet, including:

a driving roller; and a driven roller configured to rotate by being driven by the sheet while conveying the sheet by sandwiching the sheet between the driving roller and the driven roller, wherein a conveying amount measurement unit counts a pulse of a rotary encoder that is provided on a rotation axis of the driving roller or the driven roller;

an upstream side guiding member that is provided in an upstream side of a conveying direction of the sheet conveying unit, and that forms an upstream side conveying route of the sheet;

a downstream side guiding member that is provided in a downstream side of the conveying direction of the sheet conveying unit, and that forms a downstream side conveying route of the sheet;

an upstream side detection unit configured to detect the sheet conveyed in the upstream side conveying route; and a downstream side detection unit configured to detect the sheet conveyed in the downstream side conveying route, wherein a detection position of the sheet for the upstream side detection unit is set between the sheet conveying unit and a position where the sheet is in contact with the upstream side guiding member, in a conveying state where the sheet is conveyed by the sheet conveying unit and the sheet is in contact with the upstream side guiding member and the downstream side guiding member, and wherein a detection position of the sheet for the downstream side detection unit is set between the sheet conveying unit and a position where the sheet is in contact with the downstream side guiding member in the conveying state.

2. The sheet conveying apparatus as claimed in claim 1, wherein, the detection position of the sheet for the upstream side detection unit is set at an intersection point of an extension of the conveying direction of the sheet and the upstream side guiding member, and the detection position of the sheet for the downstream side detection unit is set at an intersection point of the extension of the conveying direction of the sheet and the downstream side guiding member.

3. The sheet conveying apparatus as claimed in claim 1, wherein, each of the upstream side guiding member and the downstream side guiding member is a member like a pair of plates that guides the sheet from both sides of the sheet, and the upstream side conveying route and the downstream side conveying route are in parallel with each other.

4. The sheet conveying apparatus as claimed in claim 1, wherein a step height is provided between the upstream side conveying route and the downstream side conveying route.

5. The sheet conveying apparatus as claimed in claim 1, wherein the conveying direction of the sheet is inclined with respect to each of the upstream side conveying route and the downstream side conveying route.

6. The sheet conveying apparatus as claimed in claim 1, wherein the upstream side guiding member includes a bent part, that is bent along the conveying direction of the sheet, in an end part of a downstream side of the upstream side guiding member, and the downstream side guiding member includes a bent part that is bent along the conveying direction of the sheet, in an end part of an upstream side of the downstream side guiding member.

7. The sheet conveying apparatus as claimed in claim 1, wherein the upstream side detection unit is provided on an opposite side of the downstream side detection unit with respect to the sheet to be conveyed.

8. The sheet conveying apparatus as claimed in claim 1, wherein each of the upstream side detection unit and the downstream side detection unit is an optical sensor of a transmission type or a reflection type, and the upstream side guising member and the downstream side guiding member include transparent parts at positions corresponding to detection positions of the upstream side detection unit and the downstream side detection unit respectively.

9. The sheet conveying apparatus as claimed in claim 1, further comprising:

a conveying amount measurement unit configured to measure a conveying amount of the sheet conveyed by the sheet conveying unit; and a conveying distance calculation unit configured to calculate a conveying distance of the sheet conveyed by the sheet conveying unit based on a measurement result of the conveying amount measurement unit and detection results of the upstream side detection unit and the downstream side detection unit.

10. The sheet conveying apparatus as claimed in claim 9, wherein the conveying distance calculation unit calculates the conveying distance of the sheet based on the conveying amount that is measured by the conveying amount measurement unit from a time when the downstream side detection unit detects passage of a top end part of the sheet to a time when the upstream side detection unit detects passage of a rear end part of the sheet.

11. The sheet conveying apparatus as claimed in claim 1, wherein the conveying distance calculation unit calculates a length of the sheet in the conveying direction by adding a distance between the upstream side detection unit and the downstream side detection unit to the conveying distance of the sheet.

12. An image forming apparatus comprising a sheet conveying apparatus, the sheet conveying apparatus comprising:

a sheet conveying unit configured to convey a sheet, including:

a driving roller; and a driven roller configured to rotate by being driven by the sheet while conveying the sheet by sandwiching the sheet between the driving roller and the driven roller, wherein a conveying amount measurement unit counts a pulse of a rotary encoder that is provided on a rotation axis of the driving roller or the driven roller;

an upstream side guiding member that is provided in an upstream side of a conveying direction of the sheet conveying unit, and that forms an upstream side conveying route of the sheet;

a downstream side guiding member that is provided in a downstream side of the conveying direction of the sheet conveying unit, and that forms a downstream side conveying route of the sheet;

an upstream side detection unit configured to detect the sheet conveyed in the upstream side conveying route;

a downstream side detection unit configured to detect the sheet conveyed in the downstream side conveying route;

wherein a detection position of the sheet for the upstream side detection unit is set between the sheet conveying unit and a position where the sheet is in contact with the upstream side guiding member, in a conveying state where the sheet is conveyed by the sheet conveying unit and the sheet is in contact with the upstream side guiding member and the downstream side guiding member, and wherein a detection position of the sheet for the downstream side detection unit is set between the sheet conveying unit and a position where the sheet is in contact with the downstream side guiding member in the conveying state.

* * * * *